US009610623B2

(12) United States Patent
Della Vedova et al.

(10) Patent No.: US 9,610,623 B2
(45) Date of Patent: Apr. 4, 2017

(54) METHOD AND DEVICE TO CONTROL THE SECTION SIZES OF A ROLLED PRODUCT

(75) Inventors: Ferruccio Della Vedova, Pozzuolo del Friuli (IT); Lorenzo Ciani, Udine (IT)

(73) Assignee: DANIELI AUTOMATION SPA, Buttrio (IT)

( * ) Notice: Subject to any disclaimer, the term of this patent is extended or adjusted under 35 U.S.C. 154(b) by 1150 days.

(21) Appl. No.: 13/702,971

(22) PCT Filed: Jun. 8, 2011

(86) PCT No.: PCT/IB2011/001267
§ 371 (c)(1),
(2), (4) Date: Feb. 28, 2013

(87) PCT Pub. No.: WO2012/014026
PCT Pub. Date: Feb. 2, 2012

(65) Prior Publication Data

US 2013/0160509 A1 Jun. 27, 2013

(30) Foreign Application Priority Data

Jun. 9, 2010 (IT) ..... UD2010A0113

(51) Int. Cl.
*B21B 37/16* (2006.01)
*B21B 37/46* (2006.01)
(Continued)

(52) U.S. Cl.
CPC ..... *B21B 37/16* (2013.01); *B21B 37/165* (2013.01); *B21B 37/46* (2013.01); *B21B 37/48* (2013.01);
(Continued)

(58) Field of Classification Search
CPC ..... B21B 37/16; B21B 37/53; B21B 2275/04; B21B 2275/10; B21B 2275/12;
(Continued)

(56) References Cited

U.S. PATENT DOCUMENTS 4,607,511 A 8/1986 Shore
4,662,202 A * 5/1987 Lambert ..... B21B 37/52 700/151
(Continued)

FOREIGN PATENT DOCUMENTS

EP 0219316 A2 4/1987
EP 0756906 A1 2/1997
EP 0920926 A1 6/1999

OTHER PUBLICATIONS

International Search Report and Written Opinion for PCT/IB2011/001267, European Intellectual Property Office, Nov. 22, 2012.

*Primary Examiner* — David Bryant
*Assistant Examiner* — Pradeep C Battula
(74) *Attorney, Agent, or Firm* — Mannava & Kang, P.C.

(57) ABSTRACT

A method controls the section sizes of a rolled product in a segment of a rolling line between at least two rolling stands, wherein each is provided with its own drive members, in which at least a detector located between the two rolling stands detects a characteristic size of the rolled product. A control unit compares the characteristic size of the rolled product with a reference size and acts on said drive members in order to hold the rolled product in an optimal drawing condition. The method includes setting a predefined value of an electric quantity of at least one of the drive members, measuring the reference size, and verifying the characteristic size of the rolled product in transit. If a deviation is detected between the characteristic size and the reference size, returning the characteristic size of the rolled product to the reference size.

15 Claims, 1 Drawing Sheet

(51) Int. Cl.
*B21B 37/48* (2006.01)
*B21B 38/04* (2006.01)

(52) U.S. Cl.
CPC ..... *B21B 38/04* (2013.01); *B21B 2261/10* (2013.01); *B21B 2275/04* (2013.01)

(58) Field of Classification Search
CPC . B21B 2261/02; B21B 2261/10; B21B 38/04; B21B 37/165; B21C 1/12
See application file for complete search history.

(56) References Cited

U.S. PATENT DOCUMENTS 5,101,650 A * 4/1992 Fapiano ..... B21B 37/16 700/151
5,609,053 A * 3/1997 Ferreira ..... B21B 37/16 72/11.8
5,784,914 A * 7/1998 Ciani ..... B21B 37/48 72/11.4
5,806,357 A * 9/1998 Bouchillon ..... B21B 37/16 72/10.2
6,055,834 A * 5/2000 Della Vedova ..... B21B 37/48 72/11.6
6,112,566 A * 9/2000 Palzer ..... B21B 37/16 72/10.6
6,166,537 A * 12/2000 Della Vedova ..... B21B 38/04 324/225
6,216,503 B1 * 4/2001 Kitajima ..... B21B 37/16 72/11.2
6,253,592 B1 * 7/2001 Sakurai ..... B21B 37/52 72/205
6,519,990 B1 * 2/2003 Olsson ..... B21B 37/52 72/11.6
7,086,260 B2 * 8/2006 Abi-Karam ..... B21B 37/20 700/155

* cited by examiner

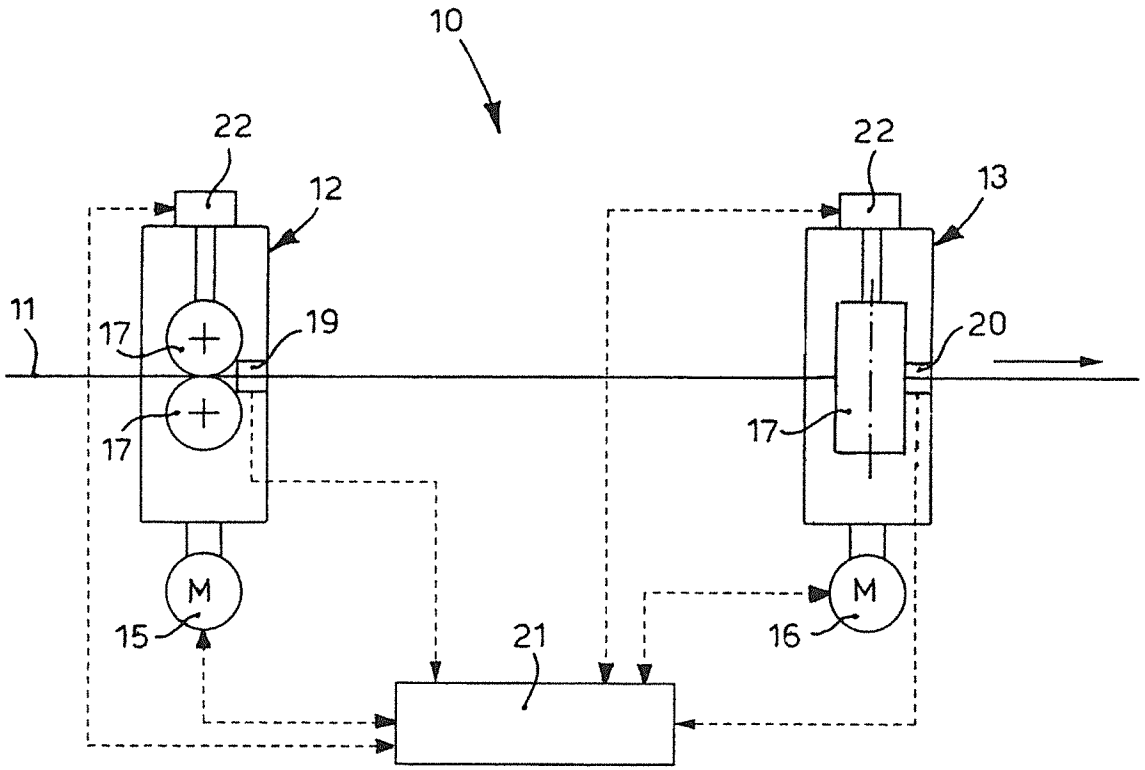
10
11
12
13
15
16
17
17
17
19
20
21
22
22
M
M

METHOD AND DEVICE TO CONTROL THE SECTION SIZES OF A ROLLED PRODUCT

FIELD OF THE INVENTION

The present invention concerns a method and the relative device to control the measurement of the section area, or at least one size such as for example one side or a diameter, of a rolled product, by adjusting the inter-stand drawing.

In particular, the invention is applied substantially to rolling and/or finishing processes, continuous or semi-continuous, in order to keep the section area of the rolled product constant and to prevent the formation of critical points and/or longitudinal deformations deriving from non-uniform sizes and temperatures of the material that feeds the rolling train.

BACKGROUND OF THE INVENTION

It is known that one of the most common problems found in rolling processes, in particular of billets and blooms, is connected to the need to keep the section area of the emerging product constant.

It is also known that the measurement is influenced by the possible presence of a drawing condition in the rolled product, between adjacent pairs of stands (hereafter referred to as inter-stand drawing).

It is also known that, in order to obtain a rolled product with substantially constant section sizes along its whole longitudinal extension it is necessary to keep the rolled product in an optimum condition of inter-stand drawing which, in some cases, is zero or almost zero.

In order to limit the variations in section size of the rolled product, a device is known, called loop former, which is disposed between two successive rolling stands and which allows to keep the inter-stand drawing at a value close to zero. In this way variations in the section area of the rolled product due to the inter-stand drawing are avoided, and also the accumulation of rolled product between the two rolling stands, which might entail a risk of jamming.

The loop former, however, does not allow to correct, by acting on the inter-stand drawing, the variations in section area of the rolled product that are generated by other causes.

The presence of the loop-former also entails a considerable increase in the length of the rolling line.

In the absence of corrective measures, the deformations and neck-downs are propagated along the rolled product and also affect unevenly the segment of material disposed between two successive stands.

This entails an unacceptable decrease in the quality of the rolled product which, sometimes, causes a large quantity of product to be discarded because it does not meet the dimensional tolerances required by the market.

In the state of the art, in order to solve this problem, various methods and devices have been proposed to control the inter-stand drawing which in some cases have given only partial results, not always satisfactory in terms of accurate and constant results, whereas in other cases they have entailed considerable complexities connected to the detection, command and control devices.

For example, U.S. Pat. No. 4,607,511 is known, in which the inter-stand drawing is controlled using a device to measure the diameter of a rolled bar passing through, located downstream of the rolling stands between which the control has to be carried out.

If there is a deviation in the expected nominal diameter, as detected by the diameter measurer, a control and command unit intervenes in order to modify the speed of rotation of the rolling rolls so as to modify the inter-stand drawing and to restore the correct conditions.

The presence of diameter measurers disposed upstream and downstream of the rolling blocks allows to detect deviations in size with respect to the nominal diameter as expected at exit from the rolling blocks, but it does not allow to identify the amount of such deviations, which derives from an incorrect inter-stand drawing with respect to the total of deviations detected.

A device to control the inter-stand drawing is also known and described in EP-A-0756906, in the name of the present Applicant, in which the inter-stand drawing is controlled and determined by correlating the detection data of two dimensional detectors disposed in an inter-stand segment. In particular, a first detector is disposed immediately at exit from one stand disposed upstream and a second detector is disposed immediately at entry to the stand disposed downstream.

By correlating the values obtained by the two detectors it is possible to obtain quite precise information on the regularity of the inter-stand drawing of the rolled product, since this correlation allows to identify inadmissible deformations or reductions in the section area, deriving from an irregular inter-stand drawing, not constant in the inter-stand segment. In fact, by detecting a characteristic size of the rolled product, such as for example the section or diameter, at two distinct points of the inter-stand segment, it is possible to determine an optimum inter-stand drawing condition corresponding to a rolled product with a characteristic size that corresponds to a reference size.

However, this solution has the disadvantage that it does not allow to determine possible rolling or drawing irregularities which are generated inside the stand, nor to identify the reasons that cause such irregularities, so that, if there are such anomalies, it does not allow to intervene with a retrospective command to restore the correct rolling and drawing conditions.

To overcome this disadvantage EP-A-0920926 is also known, again in the name of the present Applicant; this document has a solution similar to that in EP'906, with the difference that the data detected by the two detectors are sent to a control unit which, according to the data memorized in tables relating to the expected size of the rolled product at all points of the rolling line, determines actions on the drive members of the rolling stands to take the rolled product to an optimum drawing condition.

In both EP-A-0756906 and EP-A-0920926 , if a deviation of the inter-stand drawing from the optimum condition is detected, the action to correct the size of the rolled product can only be taken in rolling stands disposed downstream of the inter-stand segment; this entails large quantities of waste when the detectors are disposed in proximity to the terminal segment of the rolling line.

Furthermore, in order to be able to control the inter-stand drawing it is necessary to correlate the measurements made in at least two points of the inter-stand segment that have to be disposed at a determinate distance between them in order to obtain a sufficiently accurate detection of the drawing action.

One purpose of the present invention is to perfect a method to control the section size, or at least one size, of a rolled product by adjusting the inter-stand drawing, which is reliable, economical and functional, based on the adjustment of the speed of the individual rolling stands.

Another purpose of the present invention is to perfect a method that allows to reduce rolling waste and to intervene directly already in the inter-stand segment which is subjected to detection, in order to be able to carry out actions to correct possible deviations in the size of the rolled product.

Another purpose of the present invention is to achieve a control device that is extremely simple in its configuration and is economical to produce and manage.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a device to control the section size of a rolled product according to the present invention is applied to adjust the inter-stand drawing between at least two rolling stands each provided with its own drive members. In particular, the device comprises a detector of a characteristic size, such as the size of the section area, the diameter or suchlike, of the rolled product, disposed between the two rolling stands, and a control unit.

The control unit is configured to compare the characteristic size of the rolled product with a reference size and, in the event of a deviation, it acts on the drive members to keep the characteristic size within optimum tolerance limits, that is, to keep the rolled product in an optimum drawing condition.

According to a characteristic feature of the present invention, the method to control the section size of a rolled product by adjusting the inter-stand drawing according to the present invention comprises at least a first step of determining the reference size which provides:

i) a first sub-step in which, during rolling, the control unit detects at least an electric quantity, for example the current, of at least one of the drive members and determines an action on the latter in order to make the electric quantity assume a determinate reference value to which the optimum drawing condition corresponds;
ii) a second sub-step in which, when the electric quantity assumes the reference value, the size detector detects the real value of the characteristic size; and
iii) a third sub-step in which the value detected is considered equal to the reference size to which an optimum inter-stand drawing condition corresponds.

A second step is also provided in which the control unit compares the characteristic size, detected by the detector, of the rolled product in transit with the reference size, and a third step in which, if a deviation is detected between said size measured and the reference size, an action is carried out on at least one of said drive members to return the characteristic size of the rolled product to the reference size.

Applicant has observed a direct relation between the electric quantity detected, for example the current absorbed by the drive members, the torque that has to be supplied to the rolling rolls and the inter-stand drawing to which the rolled product is subjected.

From this consideration it is deduced that the inter-stand drawing condition is directly correlated to an electric quantity of the drive members, for example the current, and therefore an optimum drawing condition also corresponds to a determinate reference value of the electric quantity.

In some forms of embodiment, the second step provides to detect substantially continuously, or instant by instant, or discreet according to a determinate time interval, the characteristic size of the rolled product in transit during rolling.

Merely to give an example, the time interval can vary from some micro-seconds to some tenths of a second, or more, therefore giving a substantially continuous indication of the size of the rolled product.

It is advantageous to provide that during the first sub-step and/or during the third step the drive members are acted on, for example by speed adjusters, to adjust the speed of rotation of the rolling rolls.

In one solution of the invention, the electric quantity detected by the control unit is the electric current absorbed by at least one of the drive members, associated with a rolling stand, preferably the stand upstream in the inter-stand segment subjected to control.

It is advantageous to provide that the detection of the reference size and the characteristic size of the rolled product is carried out with a diameter or section measurer.

According to a variant, it is advantageous to provide that the section or diameter measurer is disposed immediately at exit from the rolling rolls, housed in or directly integrated into at least a structural element of the rolling stand which is disposed upstream of the segment of rolling line.

In this way it is possible to determine possible deviations in the section size from a reference size more promptly, so as to be able to carry out possible corrective actions, already in the inter-stand segment, thus further limiting the rolling waste.

According to a variant, if the mass flow of rolled product through the rolling line is known instant by instant, or is constant or normalized with respect to the value detected at entrance to the rolling train in the segment subjected to measuring, it is possible to make an indirect measurement of the characteristic size of the rolled product using a device to detect the speed of the rolled product, rather than a diameter or section detector.

Normalization is obtained by installing a device to measure the mass flow of the rolled product, advantageously disposed at the start of the segment subjected to control.

In this case, the characteristic size is measured by correlating the measurements of the rolled product speed detector, disposed between the two rolling stands, and the mass flow meter.

The mass flow meter comprises a section detector and a rolled product speed detector.

According to a variant of the present invention, the control unit is also configured to control the gap between the rolls of the rolling stands by detecting the electric quantity.

In particular, in order to keep the section of the rolled product constant if, for example, the gap between the rolling rolls increases, due to wear or other, then the inter-stand drawing imposed on the rolled product must be increased. Therefore, a variation in the electric quantity, for example the current absorbed, of the drive members of the rolling stands, corresponds to a variation in the inter-stand drawing.

It is therefore possible to provide a step of adjusting the gap between the rolls of the rolling stands, which comprises a first sub-step of controlling the electric quantity of the drive members, and a second sub-step in which, if the electric quantity exceeds a technical limit characteristic of the plant, the control unit acts on the gap adjustment means provided in the rolling stand, in order to return the electric quantity to the predefined value within the technical limit characteristic of the plant, while still keeping the section area of the rolled product constant.

In this way it is possible to keep control of the electric quantity of the drive members and the inter-stand drawing, preventing them from exceeding respectively the technical limits characteristic of the rolled product and of the plant.

BRIEF DESCRIPTION OF THE DRAWINGS

These and other characteristics of the present invention will become apparent from the following description of a preferential form of embodiment, given as a non-restrictive example with reference to the attached drawing wherein:

FIG. 1 is a schematic representation of a segment of a rolling line where the invention is applied.

To facilitate comprehension, the same reference numbers have been used, where possible, to identify identical common elements in the drawing.

DETAILED DESCRIPTION OF A PREFERENTIAL FORM OF EMBODIMENT

A segment 10 (FIG. 1) of a rolling line according to the present invention comprises a first rolling stand 12 and a second rolling stand 13, disposed downstream of the first stand 12, for rolling a rolled product 11.

The segment of line 10 can also comprise further conventional rolling stands, or combinations of conventional stands and fast rolling blocks.

Both the first stand 12 and the second stand 13 are driven by their own electric motors 15 and 16, which make the respective rolling rolls 17 rotate and which are each provided with speed adjusters.

A first detector 19 to detect the section of the rolled product 11 is disposed downstream of the first stand 12, while a second detector 20 to detect the section of the rolled product 11 is located downstream of the second stand 13.

The first and second section detectors 19, 20 can be of any known type, for example the magnetic type (induced currents), optical or other type, and both are connected to a control unit 21.

Both the detectors 19 and 20 allow to determine a characteristic size of the rolled product 11 which in this case is the size of the section area of the rolled product.

The section detectors 19 and 20 are directly housed and integrated in structural elements, such as for example the guide and conveyor elements, of a known type, disposed directly at exit from the rolling rolls 17 of the rolling stands 12 and 13.

In this way, the step of measuring the section size of the rolled product is made almost concurrently with the rolling step of the corresponding stand, and on a segment of the rolled product that is perfectly guided, not subject to vibrations, oscillations or other external actions that can alter the detection of the size of the rolled product 11.

With the present invention we therefore obtain a very accurate measurement of the section area of the rolled product 11 which allows to effect possible corrective actions very promptly.

The control unit 21 not only detects the section sizes of the rolled product downstream of the first and second rolling stand 12 and 13, but also detects an electric quantity of the electric motors 15, 16, in this case the current absorbed.

Furthermore, the control unit 21 is able to intervene on the speed adjusters of the motors 15, 16, to adjust the speed of rotation of the rolling rolls 17 of the stands 12 and 13 and hence their inter-stand drawing.

In particular, by acting on the difference in the rotation speed of the rolls 17 of the first stand 12 and the rolls 17 of the second stand 13 it is possible to control the inter-stand drawing to which the rolled product 11 is subjected.

Both the first 12 and the second rolling stand 13 also comprise means 22 to adjust the gap between the rolling rolls 17.

These are commanded by the control unit 21 and allow to recoup a possible increase in the gap between the rolling rolls 17, due for example to wear or other factors.

The device to control the section size of a rolled product according to the present invention functions as follows.

When it enters the first rolling stand 12, the rolled product 11 is subjected to a rolling action by the rolling rolls 17 which reduce the section sizes.

The control unit 21 detects a first value of current absorbed by the electric motor 15.

The rolled product 11, drawn from the first stand 12, enters the second stand 13 for subsequent rolling.

In this condition, the control unit 21 detects a second value of the current absorbed by the motor 15, which can be the same as, or more or less than, the first value measured.

In particular, if the current absorbed by the first stand 12 decreases, this means that the rolled product 11 is subjected to drawing by the second stand 13; if an increase is detected, the rolled product 11 is subject to thrust. In this second case there is a danger, if the section sizes of the rolled product 11 are less than a certain value, or if its peak load is exceeded, that a blockage can occur in the rolling line.

From experience, an optimum inter-stand drawing condition is known, for the geometry, type and sizes of the rolled product being processed.

The optimal drawing in turn depends on the drive torque that acts on the rolling rolls.

The drive torque is connected to the feed current of the motor, from which it is possible to determine an optimum feed current of the first stand 12, so that the rolled product 11 is subjected to an optimum inter-stand drawing condition.

In this case, after the rolled product enters the second rolling stand 13, if the control unit 21 detects a current absorbed by the motor 15 of the first stand 12 that is different from the optimum feed current, to which an optimum inter-stand drawing condition also corresponds, then it intervenes on the speed adjusters of the motors 15, 16 so that the current of the first stand 12 is taken to the desired optimum current value.

As soon as the current value is stable at the optimum value, that is, the optimum drawing condition has been reached, the detector 19 measures the section size of the rolled product 11 which is considered as reference size.

During the rolling step, the detector 19 measures the section size of the rolled product instant by instant.

If the control unit 21 detects a deviation of the size measured from the reference size, it intervenes on the speed adjusters of the motors 15 and 16 so as to modify their speed of rotation in order to adjust the inter-stand drawing, so as to keep the section of the rolled product at the reference size.

Indeed it is known that a difference between the speed of rotation of the rolls 17 in the first stand 12 and the rolls 17 in the second stand 13 allows to modify the inter-stand drawing, and hence the section area of the rolled product 11.

From the trend over time of the corrections to the speeds necessary to keep the section area to the reference size, and consequently the currents absorbed by the motors 15, 16, it is also possible to obtain information on the wear of the rolls 17. This because, if the gap between the rolls 17 increases, it is necessary to increase the inter-stand drawing so that the section of the rolled product 11 remains constant and equal to the reference value.

In order to increase the inter-stand drawing, the control unit 21 intervenes on the difference in speed of the rolls 17 to which a variation in the currents absorbed by the motors 15, 16 corresponds.

Given that the wear on the rolls 17 is a continuous process in time, unlike the deviations in measurements of the section from the reference size determined by instantaneous disturbances, it is possible to understand how this evolves over time.

In particular, when the average currents absorbed by the motors 15 and 16 exceed a pre-determined technical limit, the control unit 21 intervenes on the elements 22 to adjust the gap of the rolls 17 in order to recoup the wear and to return the drawing action and consequently the average currents absorbed to a pre-established value, which respects the dynamics of the process.

According to a variant of the present invention, if the rolling line works at a constant rolling mass flow, or at least known instant by instant, the section detectors 19 and 20 can :be replaced by detectors that detect the speed of the rolled product 11.

In this case, it is necessary to introduce, advantageously upstream of the first rolling stand 12 but also in other positions of the segment 10 of rolling line, a mass flow meter of the rolled product, comprising at least a section detector and a detector of the speed of the rolled product 11. From the combination of these two data it is possible to determine a measurement of the instantaneous mass flow of the rolled product through the rolling segment.

Given that the mass flow is known, from the detection of the speed of the rolled product by the speed detectors it is possible to determine the section of the rolled product, in an elementary fashion, at any point whatsoever of the rolling segment 10.

Using speed detectors is advantageous in that, compared with section detectors 19 and 20, they are very small in size, even with larger sizes of the rolled product.

In this case it is no longer necessary to provide that the speed detectors are disposed directly at exit from the rolling stands 12, 13. In fact, given that the rolled product is a rigid system, it is possible to dispose the detectors in any position in the inter-stand segment.

It is clear that modifications and/or additions of parts may be made to the method to control and adjust the inter-stand drawing and relative device as described heretofore, without departing from the field and scope of the present invention.

Indeed it is possible to provide to apply in succession the method and device according to the present invention to several pairs of stands in a rolling line.

For example, if downstream of the second stand 13 a third rolling stand is disposed, an optimum current of the second stand 13 is known, to which an optimum drawing condition of the rolled product between the second and third stand corresponds.

When the rolled product enters the third stand, the control unit 21, detecting a deviation of the absorbed current with respect to the optimum current of the second motor 16, intervenes on the speed adjusters of the motors of the second and third stand, in order to return the current absorbed by the second stand 13 to the optimum value.

The detector 20 measures a corresponding reference size of the rolled product in the segment between the second and third stand.

The reference size will allow, during the whole rolling process, to intervene on the speed adjusters of the motors of the second and third stand in order to keep a section of the rolled product to the reference size as above.

If the present invention is applied to several successive pairs of rolling stands, the adjustment effects on one pair of stands, in some cases, are reflected on the previous and/or subsequent pairs of rolling stands. To this end, the control unit 21 will have to coordinate the adjustment actions on the speed adjusters of the motors of the stands of the rolling line so that the adjustment action on one pair of motors does not affect the subsequent and/or preceding stands.

It is also clear that, although the present invention has been described with reference to some specific examples, a person of skill in the art shall certainly be able to achieve many other equivalent forms of method to control and adjust the drawing and the relative device, having the characteristics as set forth in the claims and hence all coming within the field of protection defined thereby.

The invention claimed is:

1. A method to control section sizes of a rolled product in a segment of a rolling line, between at least two rolling stands each provided with its own drive members, in which between said two rolling stands a characteristic size of said rolled product is detected, and a control unit compares said characteristic size of the rolled product with a reference size, to which an optimal drawing condition corresponds, and acts on said drive members in order to hold the rolled product in said optimal drawing condition, wherein the method comprises:

a first step of determining said reference size wherein said first step includes:

i) a first sub-step in which, during rolling, said control unit detects at least an electric quantity of at least one of said drive members and determines an action on the latter in order to make said electric quantity assume a determinate reference value to which said optimal drawing condition corresponds;

ii) a second sub-step in which, when said electric quantity substantially assumes said reference value, a size detector interposed between said two rolling stands detects an instantaneous value of said characteristic size; and iii) a third sub-step in which said instantaneous value is considered as a reference size;

a subsequent second step in which the control unit compares the characteristic size of the rolled product in transit, as detected by said detector, with the reference size; and a third step in which, if a deviation is detected between the characteristic size measured and the reference size, an action is carried out on at least one of said drive members in order to return the characteristic size of the rolled product to said reference size, wherein the detection of said characteristic size includes correlating detections of a detector to detect a speed of the rolled product disposed between said two rolling stands and a mass flow meter to measure said rolled product disposed in the segment subject to control.

2. The method as in claim 1, wherein said second step provides a substantially continuous detection, or instant by instant according to a determinate time interval, of the characteristic size of the rolled product in transit during rolling.

3. The method as in claim 1, wherein in said first sub-step and/or in said third step the action on at least one of said drive members is the adjustment of the speed of rotation.

4. The method of claim 1, wherein during said first sub-step the electric quantity is set of the drive member of the rolling stand disposed upstream of said segment of the rolling line.

5. The method of claim 1, wherein said electric quantity is an electric current absorbed by at least one of said drive members.

6. The method of claim 1, wherein the detection of said characteristic size is carried out in proximity to an exit of the rolled product from the rolling stand disposed upstream of said segment of the rolling line.

7. The method of claim 1, wherein the detection of said characteristic size is carried out with at least a section detector.

8. The method of claim 1, comprising a step of adjusting a gap between the rolling rolls of said rolling stands, which includes a first sub-step of controlling said electric quantity of said drive members and a second sub-step during which, if said electric quantity exceeds a predefined technical value, said control unit acts on a gap adjustment element provided on said rolling stands in order to return the electric quantity below said predefined technical value.

9. A method to control section sizes of a rolled product in a segment of a rolling line, between at least two rolling stands each provided with its own drive members, in which between said two rolling stands a characteristic size of said rolled product is detected, and a control unit compares said characteristic size of the rolled product with a reference size, to which an optimal drawing condition corresponds, and acts on said drive members in order to hold the rolled product in said optimal drawing condition, wherein the method comprises:

a first step of determining said reference size wherein said first step includes:

i) a first sub-step in which, during rolling, said control unit detects at least an electric quantity of at least one of said drive members and determines an action on the latter in order to make said electric quantity assume a determinate reference value to which said optimal drawing condition corresponds;

ii) a second sub-step in which, when said electric quantity substantially assumes said reference value, a size detector interposed between said two rolling stands detects an instantaneous value of said characteristic size; and iii) a third sub-step in which said instantaneous value is considered as a reference size;

a subsequent second step in which the control unit compares the characteristic size of the rolled product in transit, as detected by said detector, with the reference size;

a third step in which, if a deviation is detected between the characteristic size measured and the reference size, an action is carried out on at least one of said drive members in order to return the characteristic size of the rolled product to said reference size; and a fourth step including adjusting a gap between the rolling rolls of said rolling stands, which includes a first sub-step of controlling said electric quantity of said drive members and a second sub-step during which, if said electric quantity exceeds a predefined technical value, said control unit acts on a gap adjustment element provided on said rolling stands in order to return the electric quantity below said predefined technical value.

10. The method as in claim 9, wherein the second step provides a substantially continuous detection, or instant by instant according to a determinate time interval, of the characteristic size of the rolled product in transit during rolling.

11. The method as in claim 9, wherein in said first sub-step and/or in said third step the action on at least one of said drive members is the adjustment of the speed of rotation.

12. The method of claim 9, wherein during said first sub-step the electric quantity is set of the drive member of the rolling stand disposed upstream of said segment of the rolling line.

13. The method of claim 9, wherein said electric quantity is an electric current absorbed by at least one of said drive members.

14. The method of claim 9, wherein the detection of said characteristic size is carried out in proximity to an exit of the rolled product from the rolling stand disposed upstream of said segment of the rolling line.

15. The method of claim 9, wherein the detection of said characteristic size is carried out with at least a section detector.

* * * * *